United States Patent [19]

Haddad

[11] 3,934,876

[45] Jan. 27, 1976

[54] GAME RACKET

[75] Inventor: Daniel G. Haddad, Worcester, Mass.

[73] Assignee: Norman S. Blodgett, Worcester, Mass.

[22] Filed: Apr. 15, 1974

[21] Appl. No.: 460,737

[52] U.S. Cl. ..... 273/73 C; 273/76

[51] Int. Cl.[2] ..... A63B 49/02; A63B 51/02

[58] Field of Search .... 273/67 R, 73 R, 73 C, 73 D, 273/73 F, 73 H, 73 J, 75, 76; D34/5 ST

[56] References Cited

UNITED STATES PATENTS

| | | | |
|---|---|---|---|
| 2,191,287 | 2/1940 | Perryman | 273/76 |
| 2,969,984 | 1/1961 | Presnick | 273/73 R |
| 3,638,943 | 2/1972 | Snauwaert | 273/73 J |
| 3,879,035 | 4/1975 | Danchulis et al. | 273/73 C |
| D192,740 | 5/1962 | Ziabicki | 273/76 X |
| D226,206 | 1/1973 | Rankin et al. | 273/76 UX |
| D232,450 | 8/1974 | Chreist et al. | 273/73 R X |

FOREIGN PATENTS OR APPLICATIONS

| | | | |
|---|---|---|---|
| 185,275 | 9/1922 | United Kingdom | 273/73 H |
| 967,300 | 3/1950 | France | 273/73 J |
| 607,255 | 8/1948 | United Kingdom | 273/73 R |
| 16,315 | 2/1934 | Australia | 273/73 C |
| 802,060 | 5/1936 | France | 273/73 R |
| 1,503,812 | 10/1967 | France | 273/73 C |
| 766,106 | 1/1957 | United Kingdom | 273/76 |

*Primary Examiner*—Richard J. Apley

*Attorney, Agent, or Firm*—Norman S. Blodgett; Gerry A. Blodgett

[57] ABSTRACT

Game racket having a rigid open cellular network defining the contact surface rather than the conventional stringing, the network and a frame being cast as a single unit and a resilient cylindrical grip being forced over a handle of rectangular cross section and the network consisting of plates whose greatest thickness is less than the width and length.

8 Claims, 4 Drawing Figures

GAME RACKET

BACKGROUND OF THE INVENTION

A game racket having a surface for sharply contacting an air-borne game piece is an element in many popular games, including tennis, badminton, paddle ball, squash and ping-pong. Although this discussion will use the word "racket" to describe all such game elements, the field is sometimes divided into paddles, having a closed rigid contact surface, and true rackets, having a contact surface formed by placing a net of flexible string under extreme peripheral tension. The limitations of the paddle structure lie not only in the high swing weight (torsional inertia) of a normal design, but also the high wind resistance of the closed contact surface. Although the true racket structure overcomes many of the objections of the paddle structure and although the use of modern materials and technology have even overcome most of the drawbacks of the early true rackets, the fact still remains that the true racket is a composite structure of wood or metal and string and is, therefore, difficult and expensive to manufacture. It is also subject to rapid deterioration and warpage when exposed to the elements. These and other difficulties experienced with the prior art devices have been obviated in a novel manner by the present invention.

It is, therefore, an outstanding object of the present invention to provide a game racket which can be constructed with a low swing weight and low wind resistance.

Another object of this invention is the provision of a game racket which is generally homogenous in structure and can therefore be fabricated by simple mechanical methods.

A further object of the present invention is the provision of a game racket which is capable of a long and useful life with a minimum of maintenance.

Another object of the invention is the provision of a racket that is not subject to deterioration and warpage when exposed to the weather.

With these and other objects in view, as will be apparent to those skilled in the art, the invention resides in the combination of parts set forth in the specification and covered by the claims appended hereto.

SUMMARY OF THE INVENTION

This invention involves a game racket comprising an elongated handle having a grip positioned thereon suitable to be held in a human hand, an intermediate throat and shank portion and having a web defining a contacting surface, the web being rigidly held with respect to the handle, throat and shank portions. The web is comprised of a plurality of interconnected plates, each plate having the greatest thickness, a width, and a length, with the greatest thickness being substantially less than the width and the length. The length and the greatest thickness are oriented parallel to the contacting surface. The plates would be oriented so that the web would be formed as a network of open cells. The plates are so shaped that the network can be drawn from a mold without side action. The handle would be of generally rectangular cross section and the grip would involve a resilient cylinder forced over the handle.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
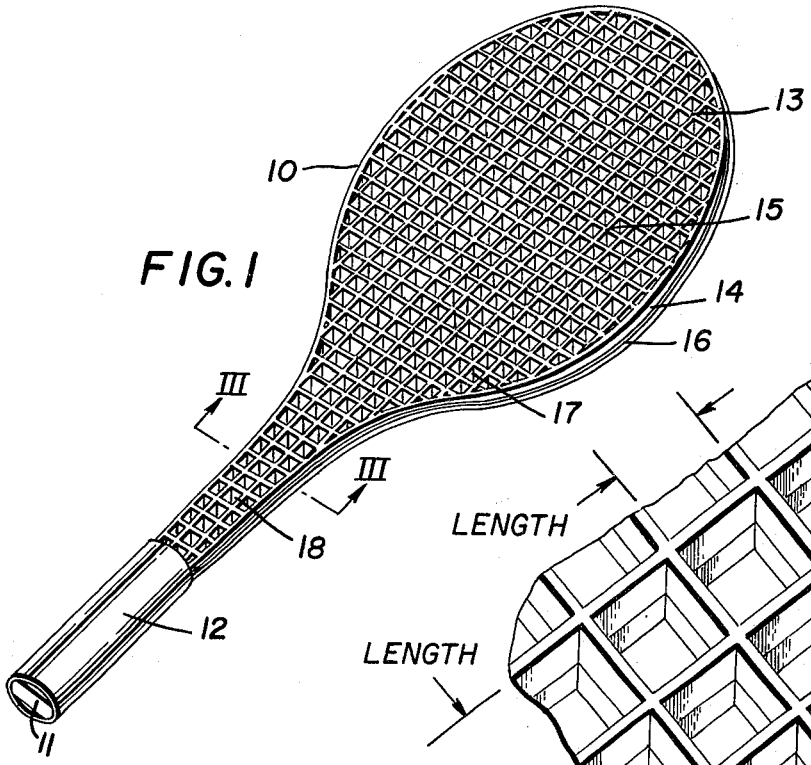
FIG. 1 is a perspective drawing of a game racket embodying the principles of the present invention.

Referring first to FIG. 1, wherein are best shown the general features of the invention, the game racket, indicated generally by the reference numeral 10, is shown as having a handle 11, a throat and shank portion 18, a grip 12 at one end of the handle 11, and a planar web 13 at the end of the throat and shank portion 18. The web 13 is rigidly held with respect to the handle 11, and the throat and shank portion 18, is surrounded by a peripheral bow 14 and defines a generally planar contacting surface 15. In the preferred embodiment, the extreme outward edge of the bow 14 is covered and protected by an expendable rib 16, also shown in FIG. 3.

Figure 2:
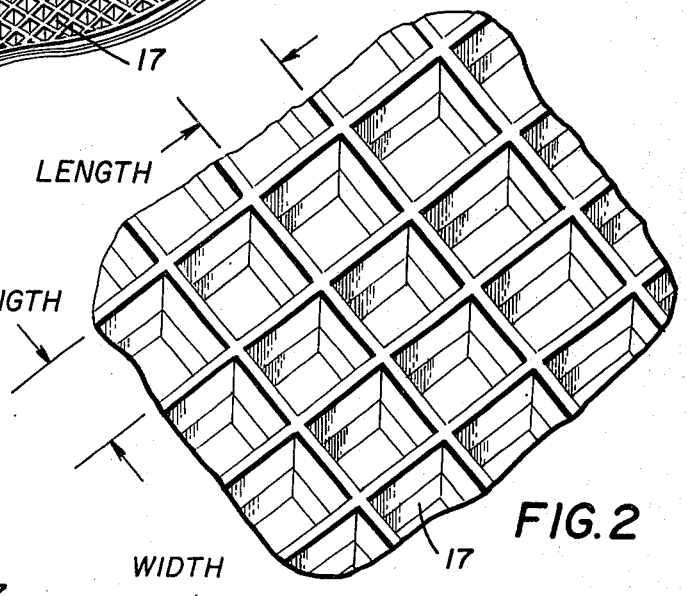
FIG. 2 is a close-up view of the web and contacting surface of the game racket illustrated in FIG. 1.

The web 13, throat and shank portion 18, and handle 11 are constructed of an opencelled network formed of a plurality of interconnected plates 17. In the preferred embodiment, the plates would be oriented either perpendicular to or parallel to the longitudinal axis of the handle. Each plate would have a smallest dimension, thickness FIG. 3, parallel to the contacting surface 15, while the other two dimensions, length FIG. 2 and width FIG. 3, would be oriented, one parallel to and one perpendicular to the contacting surface.

Figure 3:
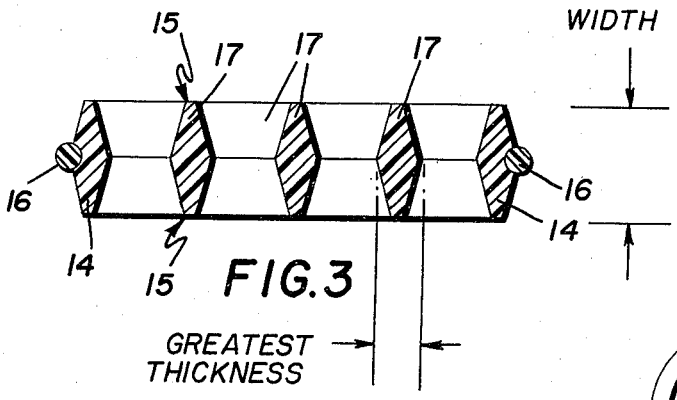
FIG. 3 is a cross-sectional view taken along the line III—III of FIG. 1.

As shown in the cross-sectional view in FIG. 3, the thickness of the plates varies from one side of the network to the other. In the preferred embodiment, the greatest thickness would be at the central portion of the plate, whereas the smallest thickness would exist adjacent the contacting surface 15 at either side of the network. A structure in which the greatest thickness was adjacent one contacting surface and the smallest thickness was adjacent the other contacting surface would also be possible. FIG. 3 also shows the position of the expandable rib 16 on the peripheral edge of the bow 14.

Figure 4:
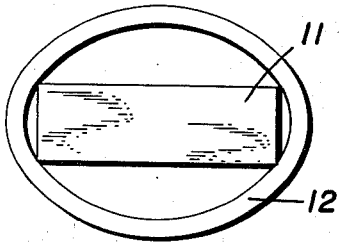
FIG. 4 is an end view of the handle and grip of the game racket illustrated in FIG. 1.

FIG. 4 shows the manner in which the grip 12 is fastened to the handle 11. As shown, the handle 11 has a generally rectangular cross section and by force-fitting a resilient cylindrical tube onto the handle, a grip suitable for being held by a human hand is provided.

The game racket as described above, can be simply and inexpensively manufactured using readily available materials and forming techniques and can replace standard rackets in many games.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A game racket, comprising: a rigid, one-piece, homogenous frame having a curvilinear head portion, an intermediate throat and shank portion, and a handle portion integral with said head portion; said head, throat, shank, and handle portions having a solid cross-section; at least said head, throat and shank portions consisting of an entirely open-celled network of a plurality of interconnected plates traversing the entire area thereof and forming a honeycomb-like matrix; each of said plates having walls which are perpendicular to the plane of said racket and constituting the width dimension thereof; each of said plates having planar upper and lower surfaces parallel to the central plane of said racket, said planar surfaces being exposed at least at said head, throat and shank portions and constituting two ball contact surfaces of said head portion, the planar surfaces of each of said plates constituting the length dimension thereof; said width dimension being approximately equal to said length dimension; each plate further having a nonuniform thickness with one location of greatest thickness wherein said greatest thickness is less than each of said width and length dimensions and being oriented parallel to said contact surfaces of said racket; and hand grip means covering said handle portion to provide a gripping surface for the user.

2. A game racket as recited in claim 1, wherein said cross-section of each of said plates is a lozenge-shaped.

3. A game racket as recited in claim 1, wherein said open-celled network extends throughout said handle portion.

4. A game racket as recited in claim 1, wherein said plates have a smallest thickness adjacent at least one of said contact surfaces.

5. A game racket as recited in claim 1, wherein said matrix is in the form of square apertures as viewed in the direction perpendicular to said contact surfaces.

6. A game racket as recited in claim 1, wherein said handle portion has a rectangular cross-section and said hand grip means comprises a resilient cylindrical tude.

7. A game racket as recited in claim 1, wherein said frame is surrounded by an integral peripheral bow of like shape as each of said plates.

8. A game racket as recited in claim 7, wherein the peripheral edge of said bow is protected by an expandable rib.

* * * * *